US005515622A

United States Patent [19]

Lee

[11] Patent Number: 5,515,622

[45] Date of Patent: May 14, 1996

[54] SHOE CONSTRUCTION

[75] Inventor: Sang Y. Lee, Pusan, Rep. of Korea

[73] Assignee: Ewing Athletics Co., Ltd., Nassua, Bahamas

[21] Appl. No.: 215,063

[22] Filed: Mar. 21, 1994

Related U.S. Application Data

[63] Continuation-in-part of Ser. No. 72,546, Jun. 4, 1993, abandoned.

[51] Int. Cl.[6] ..... A43B 7/06

[52] U.S. Cl. ..... 36/3 R; 36/3 B

[58] Field of Search ..... 36/3 R, 3 A, 3 B, 36/103, 114, 25 R, 28, 29, 30 R, 35 R, 35 B, 34 R, 43, 88, 92

[56] References Cited

U.S. PATENT DOCUMENTS

| | | | |
|---|---|---|---|
| 311,046 | 1/1885 | Trask | 36/3 B |
| 896,488 | 8/1908 | Valiant . | |
| 1,159,758 | 11/1915 | Gambino | 36/35 B |
| 1,660,698 | 2/1928 | Williams, Sr. | 36/3 B |
| 1,890,433 | 12/1932 | Cohen | 36/3 B |
| 2,414,910 | 1/1947 | Stritter | 36/30 R |
| 2,668,372 | 2/1954 | Wright . | |
| 3,331,146 | 7/1967 | Karras | 36/3 R |
| 4,063,371 | 12/1977 | Batra . | |
| 4,071,963 | 2/1978 | Fukuoka . | |
| 4,137,653 | 2/1979 | Famolare, Jr. . | |
| 4,417,407 | 11/1983 | Fukuoka | 36/3 B |
| 4,602,441 | 7/1986 | El Sakkaf | 36/3 R |
| 4,860,463 | 8/1989 | Pin . | |
| 4,995,173 | 2/1991 | Spier . | |
| 4,999,932 | 3/1991 | Grim . | |
| 5,010,661 | 4/1991 | Chu | 36/3 R |
| 5,068,981 | 12/1991 | Jung . | |

FOREIGN PATENT DOCUMENTS

| | | | |
|---|---|---|---|
| 579284 | 7/1959 | Canada | 36/3 B |

*Primary Examiner*—Thomas P. Hilliard
*Attorney, Agent, or Firm*—Wolf, Greenfield & Sacks

[57] ABSTRACT

A ventilation system for footwear having an upper and sole assembly in which perforations or openings in the sole assembly connect the interior of the shoe through a duct or passage into a pumping chamber or air bag. A pair of one-way valves connect the duct to the chamber or air bag and from the chamber or air bag outwardly through a single valve in the rear of the heel of the shoe for movement of air rearwardly through the shoe. The air bag is preferably 23.3 percent in volume of the total volume of the interior of the shoe.

3 Claims, 10 Drawing Sheets

SHOE CONSTRUCTION

This application is a continuation-in-part application of Ser. No. 08/072,546, filed Jun. 4, 1993, now abandoned, which is fully incorporated herein by reference.

BACKGROUND OF THE INVENTION

1. Field of the Invention

The present invention relates to ventilated footwear including specifically sneakers and shoes having a ventilation system in which air is circulated about the wearer's foot by a pump mechanism located in the shoe sole.

2. The Prior Art

Ventilation systems for footwear have been known and used in the past. A variety of ventilating systems are illustrated in several previously issued U.S. Letters Patents. Some of these include systems which utilize pumping systems to draw air around the foot and move it outwardly of the shoe sole. Some of these are passive systems and include, for example, shoes having perforations in the upper part of the shoe construction. The art known to the applicant which is most relevant includes U.S. Pat. Nos. 4,137,653; 4,860,463; 4,995,173; 4,999,932; and 5,068,981.

Famolare, Jr. U.S. Pat. No. 4,137,653, discloses footwear with snorkel ventilation. A snorkel tube extending along the back of the boot in the heel area provides air to passages. A compression of these passages forces air back out of the tube.

Pin U.S. Pat. No. 4,860,463 discloses footwear having ventilation and shock absorbing properties. The shoe includes a separate elastic pad inserted in the heel portion of the sole and contains a series of elongated holes closed at one end and connected at the other to a transverse ventilation channel having a pair of oppositely aligned one way valves. A series of longitudinally extending channels in the forefoot and instep portions of the sole connect the ventilation channel to the interior of the shoe. A second series of one way valves are located in these longitudinal channels. In this system, air is drawn through the longitudinal channels into the transverse channels and is forced laterally outwardly on either side of the shoe upon the compression of the heel by the wearer's foot. This system requires a specially designed outer sole, an unusually designed elastic pad, located valves on the sides of the shoe, and includes a pump which is not self-flushing.

Spier U.S. Pat. No. 4,995,173 discloses footwear using a pump for purposes of inflating a bladder in the shoe upper. It does not disclose a system for ventilation.

Grim U.S. Pat. No. 4,999,932 discloses a variable support shoe. A pump draws air through an inlet valve in the rear of the shoe and pumps it through an outlet valve into air bladders. The system does not provide ventilation but merely support.

The Jung U.S. Pat. No. 5,068,981 discloses a self-ventilating device for shoe inner soles. The complex insert located in the heel provides an air intake system to a chamber which is compressed against spring tension to exhaust air through side openings. The inlet to this system opens into a hollow formed in the instep and forefoot of the shoe.

SUMMARY OF THE INVENTION

It is an object of the present invention to provide ventilated footwear and, in particular, a ventilated sneaker having a positive pumping system for moving air from the interior of the shoe through the sole and heel and outwardly from the heel.

A further object of this invention is to provide a walking-actuated ventilation system for footwear which may be made by modifying standard components of a shoe in a manner which does not require significantly additional expense over conventional manufacturing procedures and steps.

A further object of the present invention is to provide a shoe having an improved ventilating pump system which is easy to manufacture from molded or die-cut components which may be assembled using conventional assembly techniques. Such a system includes a single air exit port in the surface of the shoe located at the heel in an area of the shoe which is least likely to be damaged.

A further object of the present invention is to provide an improved ventilated shoe having few moving components which are sturdy and not likely to break down with prolonged use.

A further object of the present invention is to provide a ventilated shoe construction in which the ventilating system is essentially self-flushing or self-cleaning and which will not ordinarily allow collection of foreign matter in the ventilating system.

A still further object and advantage of the present invention is to provide an improved ventilating system for footwear in which the operative nature of the system can be viewed through the shoe sole and which includes transparent components of attractive design.

A still further object of the present invention is to provide a ventilation system having a preferred dimensional relationship with the size of the shoe interior thereby maximizing the cooling effect on the wearer.

The foregoing objects and advantages of the present invention are achieved, in a preferred embodiment, by providing ventilated footwear having an upper and sole assembly in which perforations or openings in the sole assembly connect the interior of the shoe through a duct or passage into a pumping chamber. A pair of one-way valves connect the duct to the chamber and from the chamber outwardly through a single valve in the rear of the heel of the shoe for movement of air rearwardly through the shoe.

In a second embodiment, an air bag is provided instead of merely a chamber. The air bag has an interior volume approximately 4.3 smaller than the interior of the shoe.

BRIEF DESCRIPTION OF THE DRAWINGS

Other objects and features of the present invention will become apparent from the following detailed description considered in connection with the accompanying drawings which discloses one embodiment of the present invention. It should be understood, however, the drawings are designed for purpose of illustration only and not as a definition of the limits of the invention.

In the drawings, similar reference characters indicate similar elements through the several views:

FIG. 13 is a fragmentary cross-sectional side elevational view of a second embodiment, showing the air bag as air and moisture are drawn in;

DETAILED DESCRIPTION OF PREFERRED EMBODIMENTS

Figure 1:
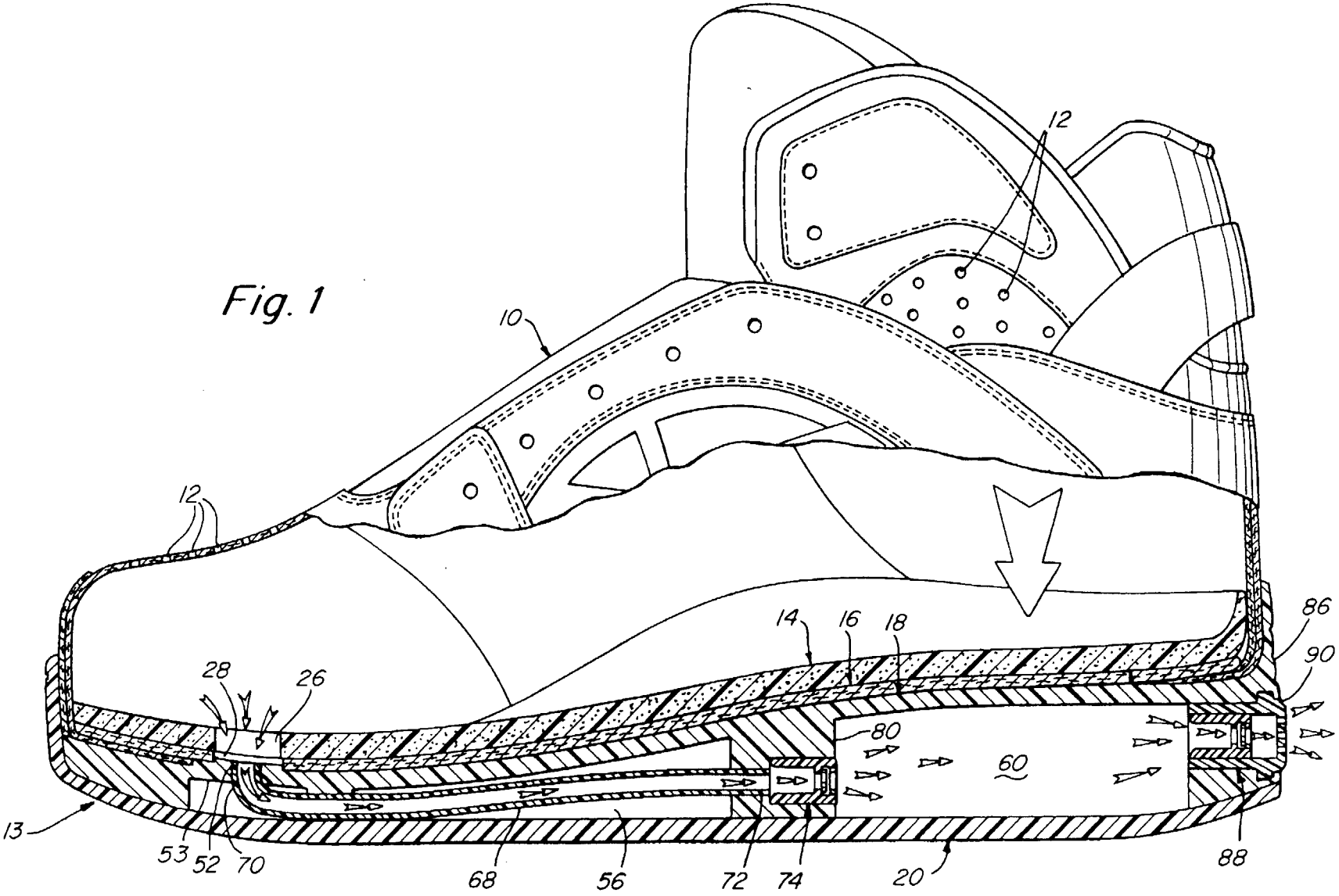
FIG. 1 shows a side elevation of a sneaker having a cross-sectional segment which illustrates a portion of the sole construction.
Figure 2:
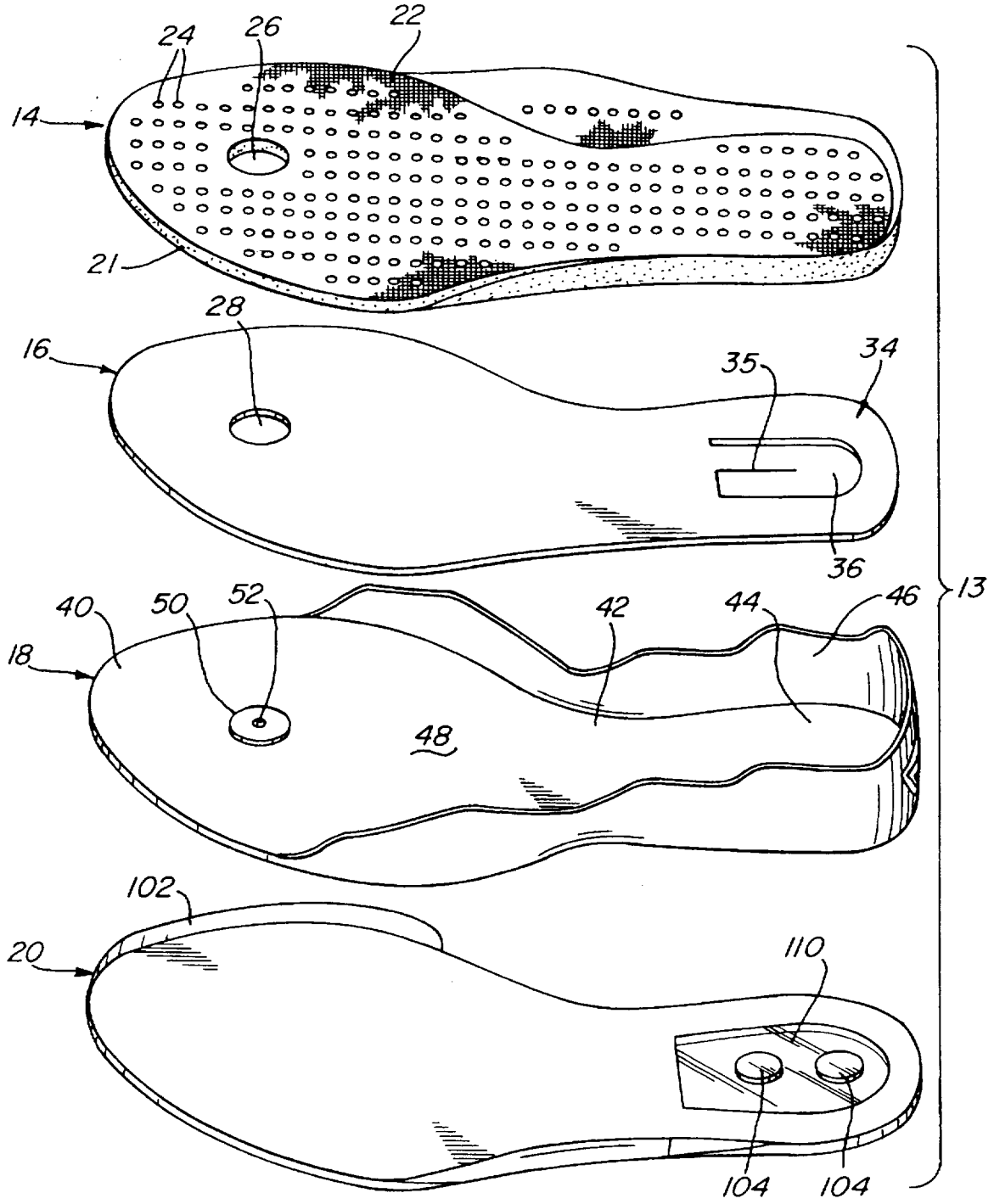
FIG. 2 is an exploded perspective view of the sole assembly.
Figure 3:
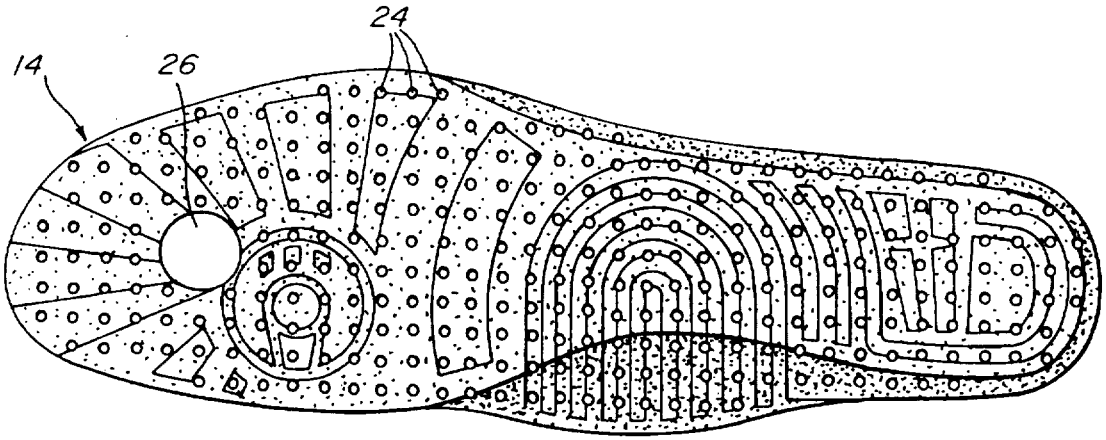
FIG. 3 is a bottom plan view of the footbed.

The present invention is illustrated in an embodiment of a high-top sneaker. In this sneaker, an upper 10 is conventionally formed in any suitable fashion. In a preferred embodiment, the upper 10 is formed with at least one section, but preferably several, having a series of perforations 12. As illustrated in the preferred embodiment, the series of perforations 12 may be located in the vamp of the upper 10 and in the ankle region. The upper 10 is conventionally secured to a sole assembly 13 illustrated with its component parts in FIG. 2.

The sole assembly 13 includes a footbed 14, insole 16, midsole 18, and outer sole 20, each having a peripheral shape designed to conform to the shape of a wearer's foot. The footbed 14 may comprise a conventional foam plastic supporting member 21 with a fabric sock liner 22 integrally secured to the upper surface of the supporting member 21. A plurality of perforations 24 may be formed throughout the surface of the footbed 14 with these perforations 24 extending entirely through the footbed 14. An opening 26 larger than the perforations 24 is located in the forepart of the shoe.

The insole 16 is formed of conventional insole material which may include, for example, a stiffened cardboard, or the like. An opening 28 has a diameter essentially equal to an vertically aligned with the opening 26 in the footbed 14. The heel portion 34 of the insole 16 may have a continuous cut 35 formed therein generally in the shape of a capital "G". This cut 35 forms a tongue 36 which is vertically moved on pressure in the heel portion 34 of the sole construction 13. Thus, when the wearer puts pressure on the heel, the tongue 36 is depressed to a position lower than the main portion of the insole 16.

The midsole 18 is formed with a forepart 40, instep 42, and heel region 44 aligned with corresponding portions in the insole 16, footbed 14, and outer sole 20. The midsole 18 is formed with an integrally upwardly extending flange 46 that extends from the rear of the toe area along the medial to the heel region 44 of the midsole 18 and then around the lateral side of the midsole 18 to the forepart 40 of the midsole 18. The upper surface 48 of the midsole 18 is flat except for a detent or dog 50 which projects upwardly into locking engagement with the opening 28 in the insole 16. The detent 50 is formed with an axial opening 52 that extends through the midsole 18.

Figure 4:
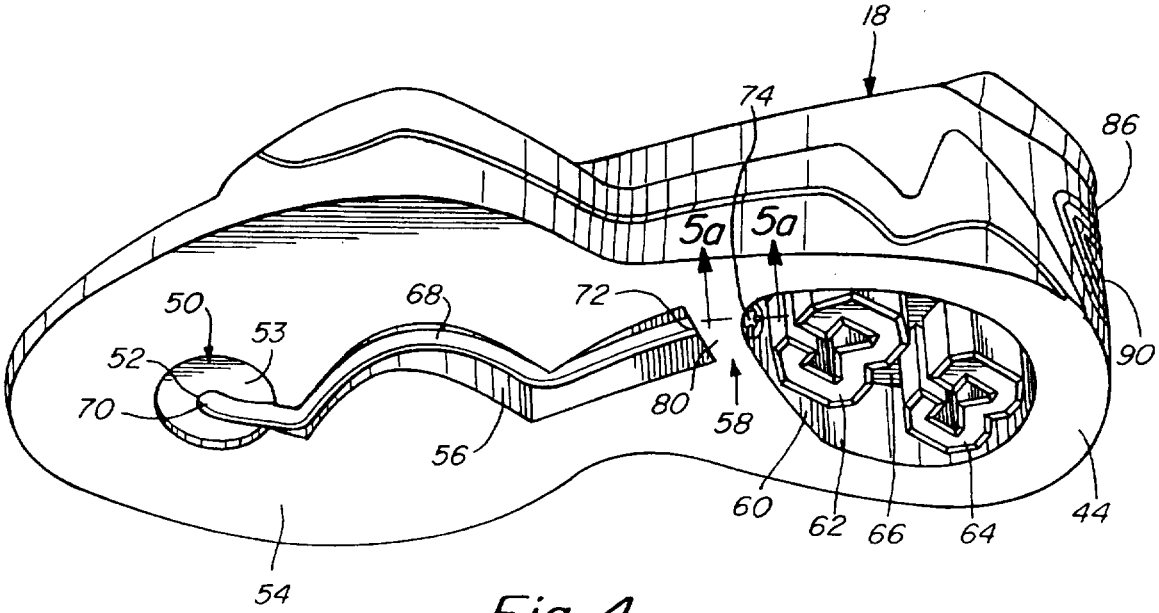
FIG. 4 is a perspective bottom view of the midsole.

The lower portion of the midsole is best illustrated in FIG. 4. In this arrangement, the lower surface 54 of the midsole 18 is formed with a duct or channel 56 that extends from the bottom 53 of the detent 50 rearwardly in an irregular or zig-zag course to the instep region 58 of the midsole. In the heel region 44 of the midsole 18 there is formed an air chamber 60 which occupies substantially the entire area of the heel region 44 and has a configuration generally similar in shape to the heel region 44. The midsole 18 is integrally molded with a pair of downwardly extending pillars 62 and 64 formed in the chamber 60 and connected on the inner side 66 of the chamber 60. As illustrated in FIG. 4, these pillars 62 and 64 have the shape of numerals 33, or any other decorative shape. The pillars 62 and 64 have a normal height that is equal to the height of the chamber 60 from surface 66 to lower surface 54, but may be compressed when the chamber 60 is compressed. These pillars 62 and 64 function essentially as a spring member to return the chamber 60 to an open expanded position when not under compressive forces from the weight of a person. Thus, the pillars 62 and 64 not only provide the pumping mechanism, but also act as shock absorbers for the tremendous forces imparted on the shoe during normal use, including jumping and running commonly associated with basketball play.

Figure 5A:
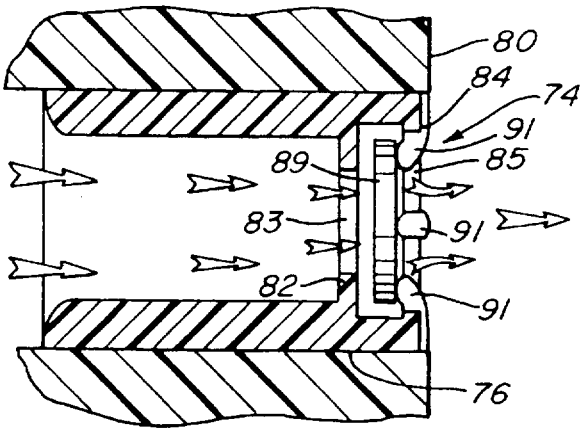
FIG. 5*a* is a cross-sectional detail of a valve taken essentially along the line 5*a*—5*a* of FIG. 4.
Figure 5B:
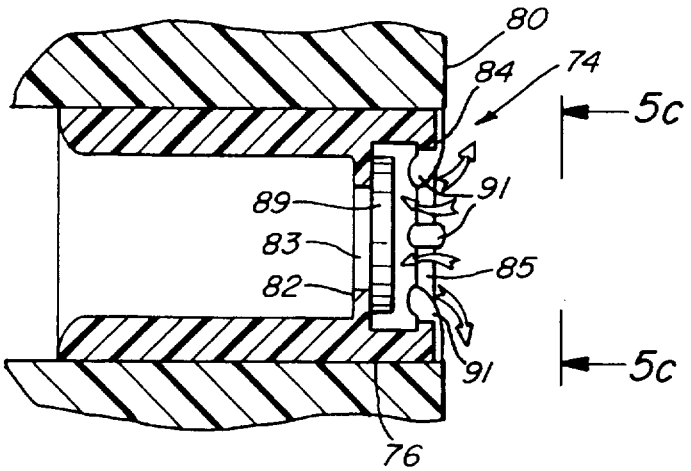
FIG. 5*b* is a cross-sectional detail of the valve of FIG. 5*a* in a second orientation.
Figure 5C:
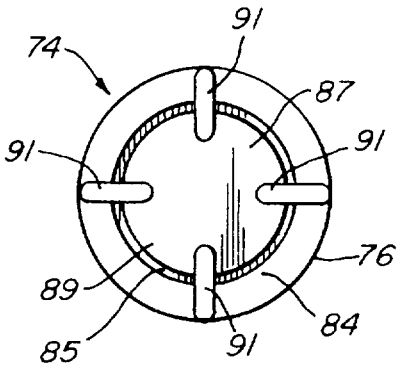
FIG. 5*c* is a plan view of the valve of FIG. 5*a* taken along the lines 5*c*—5*c* of FIG. 5*a;*
Figure 6:
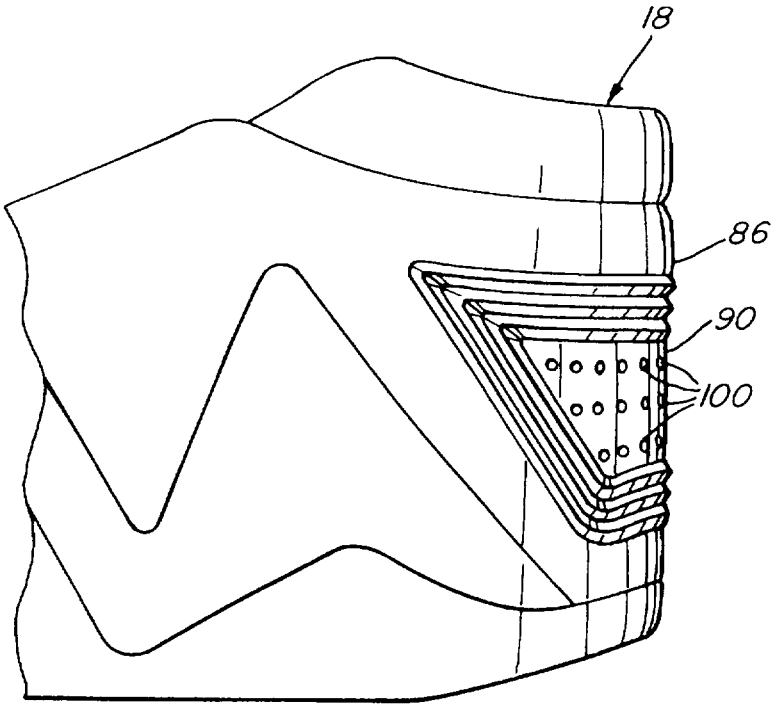
FIG. 6 is a fragmentary enlarged view of the heel end of the midsole.
Figure 7:
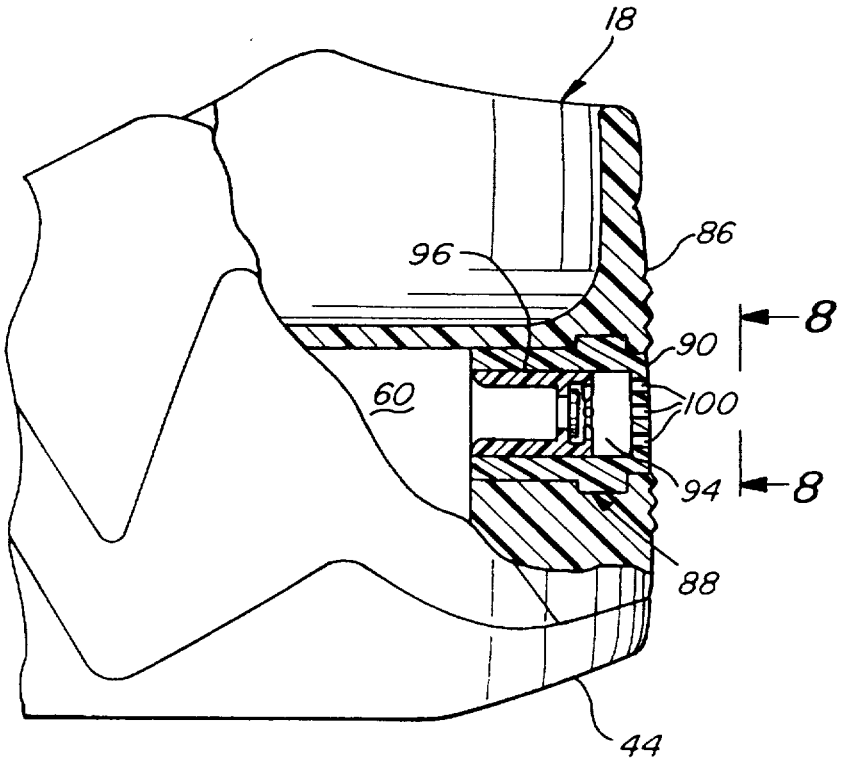
FIG. 7 is medial longitudinal cross-sectional view of the heel section of the midsole shown in FIG. 6.
Figure 8:
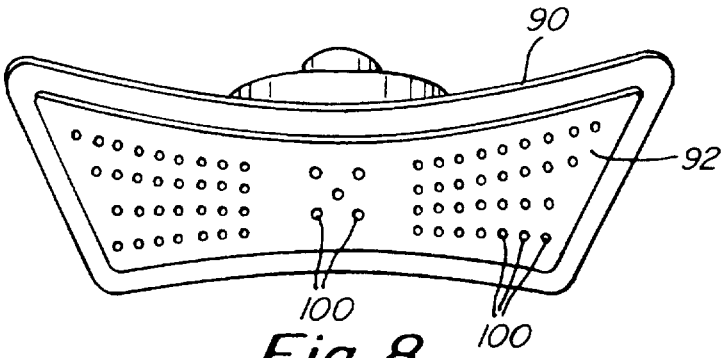
FIG. 8 is an end view of a component taken from the line 8—8 of FIG. 7.
Figure 9:
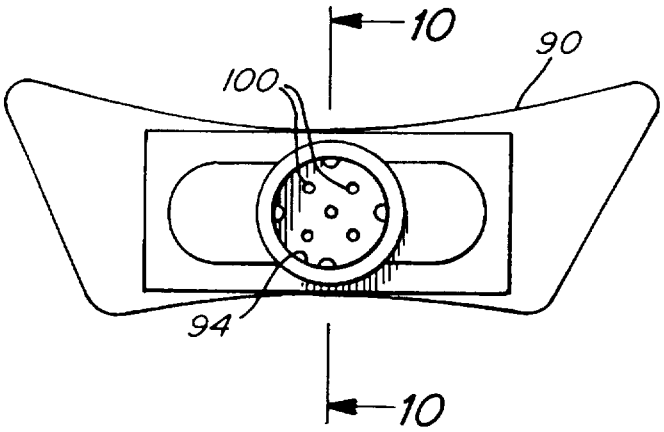
FIG. 9 is an elevational view of the component of FIG. 8 taken from the opposite end.
Figure 10:
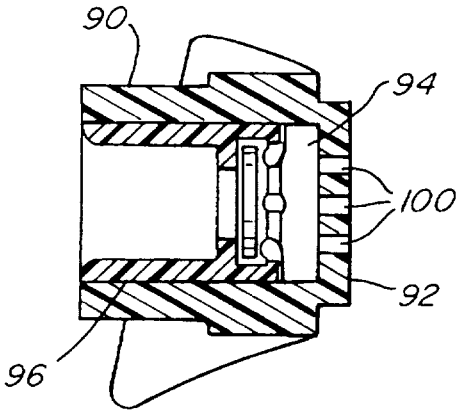
FIG. 10 is a cross-sectional view of the component of FIG. 9 taken along line 10—10 with the valve in place.

An elongated tubular member 68 is connected at one end 70 to the opening 52 (FIG. 2) in the midsole 18. The other end 72 is in fluid communication with a one-way valve 74 best illustrated in FIGS. 5*a*–5*c*. The valve 74 is located between the chamber 60 and the passage 56. The valve 74 sits in and is frictionally secured to a bridge member 80 that divides the chamber 60 from the passage 56. The valve 74 consists essentially of a flexible tubular member 76, preferably made of polyvinyl chloride. The end of the valve 74 facing the chamber 60 has a first annular flange 82 defining a first opening 83 and a second annular flange 84 defining a second opening 85 formed by a series of inwardly extending members 91 having spaces 87 therebetween (FIG. 5*c*). A disc 89, having a diameter larger than the first opening 83 but smaller than the second opening and 85, is positioned between the first and second flanges 82 and 84. The disc 89, is small enough so that the spaces 87 cannot be completely covered.

Air moving through the tube 68 will pass through the valve 74. As the air enters the valve 74, it forces the disc 89 against the fingers 91 of the second flange 84 While the air flows through the spaces 87 and into the chamber 60 (FIG. 5*a*). If higher pressure exists on the other side of the valve 74, that is, from the chamber 60, the disc 89 will be forced against the first annular flange 82 thereby preventing air flow into the passage 56 (FIG. 5*b*). The valve is accordingly a one-way valve which permits air to pass from the passage 56 into the chamber 60.

A second one-way valve is positioned in the rear of the midsole at the back 86 of the heel portion. This valve assembly 88 is best illustrated in FIGS. 6–10. A support 90 formed of plastic has an outer surface 92 (FIG. 8) conforming in shape to the back of the heel. The valve assembly 88 is integrally formed in the midsole 18 at the rear end of the heel region 44. The valve 96 is positioned within a cylindrical, central opening 94 defined by the support 90. The valve 96 is similar in construction to valve 74 shown in FIG. 5 and is oriented in the same longitudinal direction so as to permit one-way movement of air from the chamber 60 outwardly through the valve 96 and through openings 100 on the outer surface 92 of the support 90.

The outer sole 20 (FIG. 2) is formed with an upwardly extending flange 102 that extends around the forepart of the shoe to engage the other aligned components. A series of supports 104 may be integrally formed on the upper surface of the outer sole 20 in vertical alignment with the pillars 62 and 64. These supports 104 may also be shaped to match the configuration of the pillars 62 and 64.

The outer sole 20 may also be formed of two materials including transparent segment such as segment 110 suitably bonded to the remainder of the sole 20. The transparent segment 110 of the outer sole 20 is located immediately below the chamber 60 permitting the interior of the chamber to be readily observed. The transparent segment 110 may be further expanded to permit viewing of the tubular member 68. The decorative emblems, such as the numeral "33" at the bottom of the pillars 62 and 64, provide added decorative features to the shoe construction. Similarly, the supports 104 may also be in the same decorative shape, such as the numeral "33".

The ventilation assembly in the present invention provides a cooling system for the foot of the wearer. In operation, ambient air moves through the perforations 12 into the interior of the shoe. As the wearer of the shoe walks and lands on his heel, the force of his weight compresses the chamber 60 against the resistance of the pillars 62 and 64. When the chamber 60 is compressed, air within the chamber is forced outwardly through the valve 96 in the rear of the shoe. When the compressive force is released, the resilient pillars 62 and 64 expand chamber 60, thereby returning the chamber 60 to its normal open position. Air is drawn into the chamber 60 through valve 74 illustrated in FIG. 5. This air is supplied to the valve through the tube 68 and from the interior of the shoe.

Since air moves longitudinally from the forepart of the shoe at opening 52 rearwardly through the duct or passage 68 into the chamber 60 and outwardly through the rear valve, any moisture that may accumulate is forced along these passages and outwardly. Thus, the movement of air rearwardly from the forepart of the shoe constantly purges the ventilating system. The purging action will remove condensation that might collect in chamber 60. Since the system uses an outlet valve at the rear of the heel, the likelihood of damage to the ventilation system is minimized.

Figure 11:
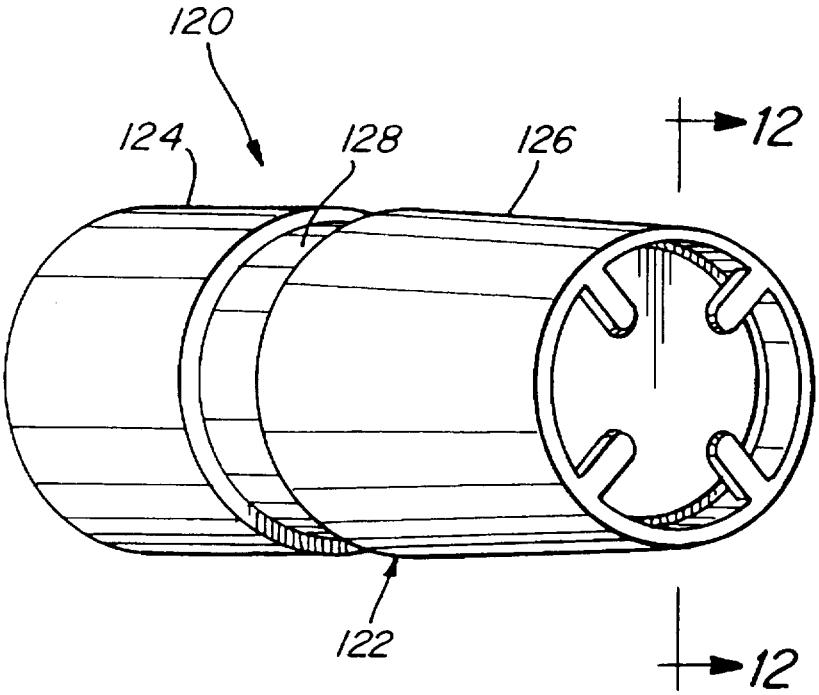
FIG. 11 is a perspective view of a second embodiment of the valve.
Figure 12:
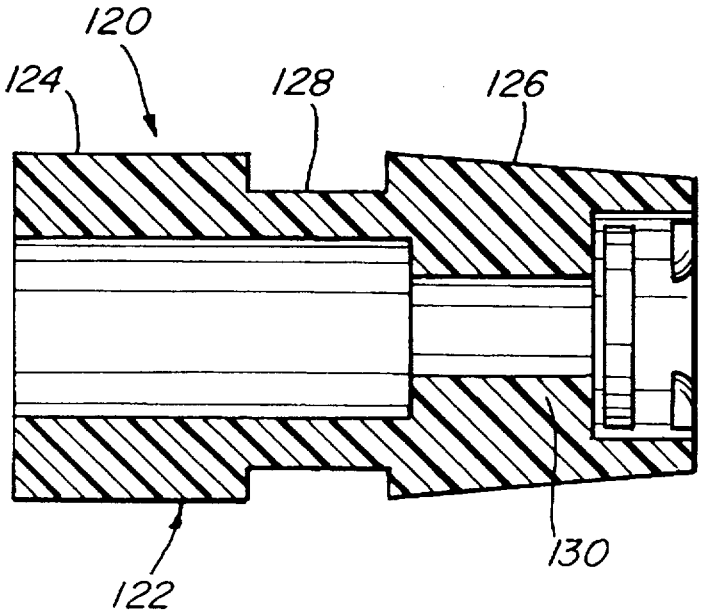
FIG. 12 is a cross-sectional view taken along the line 12—12 of FIG. 11.

A second embodiment 120 of the valves 74 and 96 is shown in FIGS. 11 and 12. The principles remain the same, only the shape of the corresponding tubular member 122 is different. The member 122 has a straight portion 124 and a tapered portion 126 separated by a notch 128. As seen in the cross-sectional view of FIG. 12, the corresponding first flange 130 has a substantial width. The overall design of the second valve embodiment 120 provides a sturdy valve which may be easily secured within the ventilation system.

A second embodiment of the chamber 60 is shown in FIGS. 13–18. The basic arrangement of an air ventilation system is the same in the second embodiment. However, this second embodiment includes an air bag 150 having defined chamber enclosing walls 152 rather than a chamber formed by cut out regions in the shoe layers.

Figure 13:
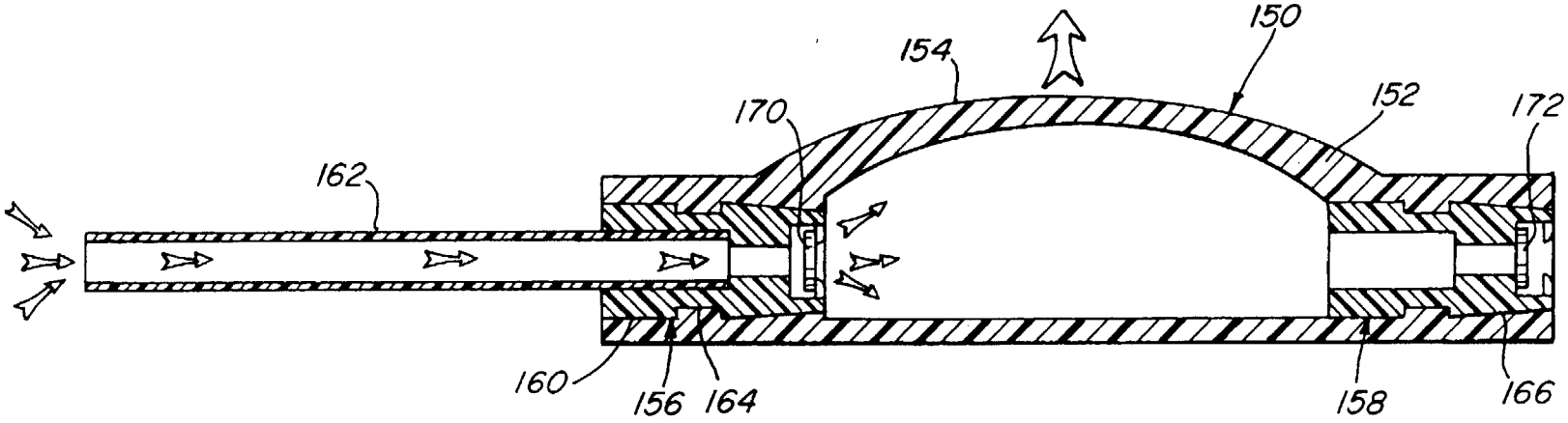
Figure 15:
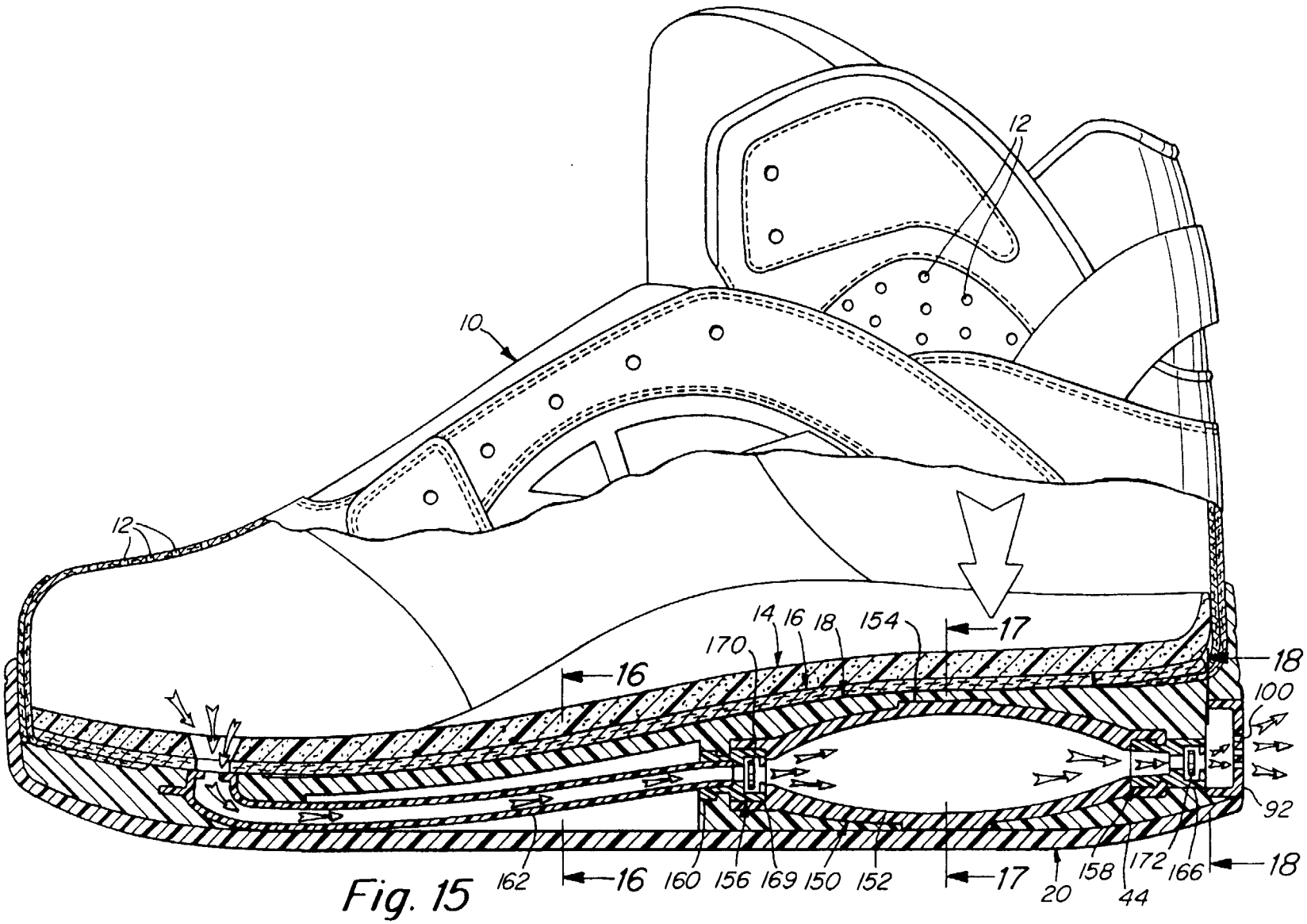
FIG. 15 is a side elevation of a sneaker having a cross-sectional segment which illustrates a position of the shoe construction using the second embodiment.
Figure 16:
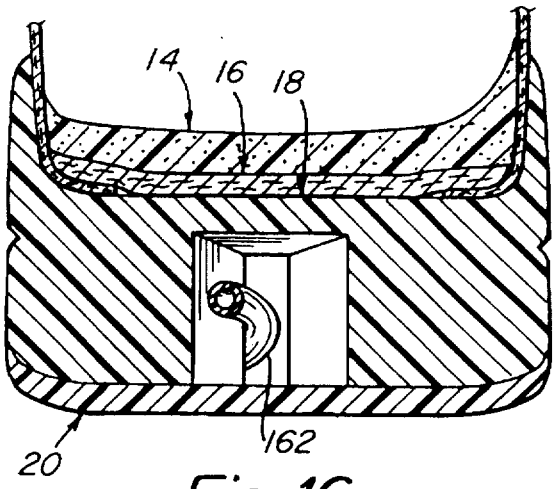
FIG. 16 is a cross-sectional view taken along the line 16—16 of FIG. 15.
Figure 17:
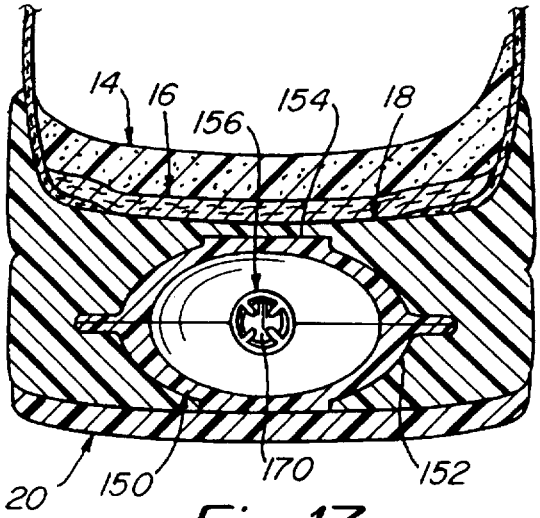
FIG. 17 is a cross-sectional view taken along the line 17—17 of FIG. 15.
Figure 18:
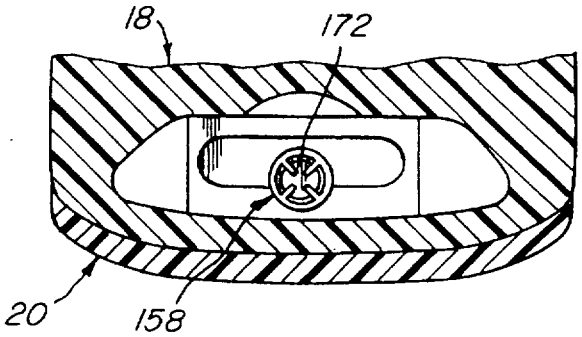
FIG. 18 is a cross-sectional view taken along the line 18—18 of FIG. 15.

The air bag 150 is positioned in the shoe in the heel region 44 of the shoe. The air bag may assume a variety of shapes including having only a dome-shaped top portion 154 as seen in FIG. 13, or having both a rounded top and bottom to resemble a pillow-like object as seen in FIGS. 15 and 17. The air bag 150 is preferably made from polyester elastomers, such as HYTREL, a Dupont product, or from any number of resilient flexible sheet plastics or other materials which provide the desired qualities including strength, durability, and resiliency. The walls of the air bag must be capable of returning the air bag when unstressed to its normal shape defining an air containing chamber. In the present embodiment, the walls are preformed to be self-supporting and having a normal unstressed volume of approximately 23.3 percent of the total volume of the shoe as will be discussed below.

Similar to the first embodiment, the air bag 150, like the chamber 60, has a pair of one-way valves 156 and 158 at either end. The valves 156 and 158 illustrated in FIGS. 13–15, 17, and 18 are described above with respect to FIGS. 11 and 12.

Figure 14:
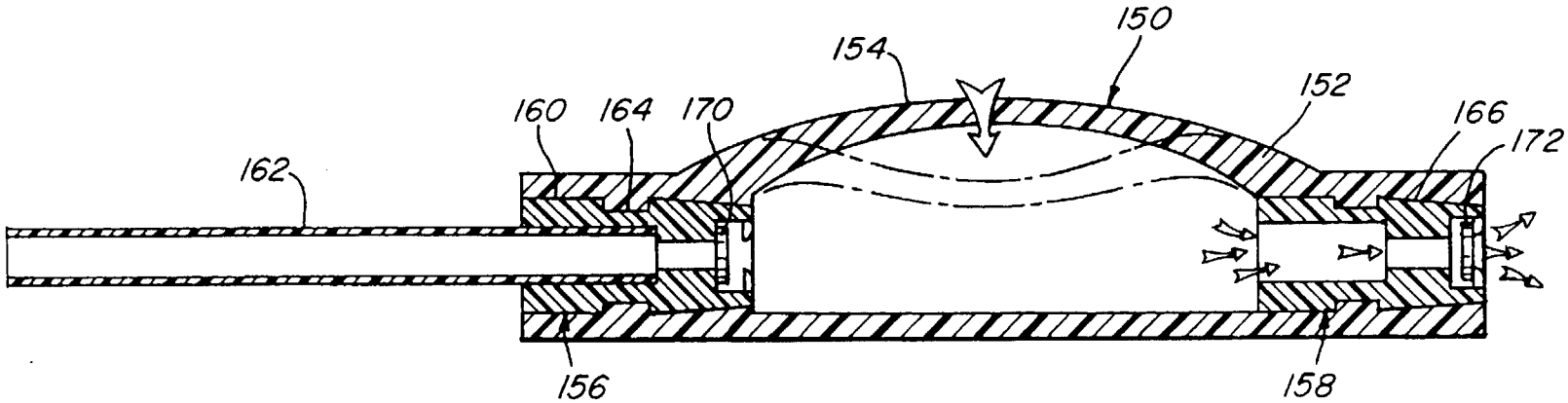
FIG. 14 is a cross-sectional view similar to FIG. 13, except the air and moisture is being expelled from the air bag with the compressed shape of the air bag shown in phantom.

While the valves shown in FIGS. 13 and 14 are completely encapsulated in the air bag 150, portions of the valves may extend beyond the walls 152 of the air bag 150 as shown in FIG. 15. Thus, the projecting portion 160 of valve 156 may receive the passage or tube 162 outside the air bag walls 152. In this arrangement, the valve 156 may be secured to the air bag 150 along the notch portion 164 or forward portion 169. Similarly, valve 158 may have its tapered or forward portion 166 extend beyond the air bag walls 152. This arrangement may facilitate alignment of the valve 158 with the openings 100 of the outer surface 92 of the support as shown in FIG. 15.

In the operation of this second embodiment, as the air bag 150 returns to its original shape after compression. This the upward movement of the dome portion 154 of the air bag 150 expands the chamber and draws in air and moisture through the tube 162 and a second opening at the interior of the shoe as described with respect to the first embodiment. The suction created by the upward movement of the resilient air bag draws the respective discs 170 and 172 of the valves 156 and 158 inwardly towards the center of the chamber. This closes valve 158 and opens valve 156, thus creating the intake of air and moisture through the tube 162. FIGS. 13 and 14 provide a better illustration of the air flow than FIG. 15.

On a subsequent step, when the wearer lands on the heel portion of the shoe, air and moisture is expelled. Downward pressure on the dome 154 of the air bag 150 causes both discs 170 and 172 to move outward as shown in FIG. 14. This movement closes valve 156 and opens valve 158, thus expelling the air and moisture in the chamber out the rear of the shoe. The operation repeats as the now deformed air bag 150 returns to its original shape as shown in FIG. 13.

It has been determined that the average athlete, having a body temperature of 37.0° C., exercises in arenas and other locations having temperatures in the range of 20.0° C. to 30.0° C. Based on these values, the maximum cooling effect on the athletes falls within the range of 7.0° C. to 17.0° C. below body temperature, and the air bag 150 should be sized accordingly.

With computer aided design and experimentation on a U.S. size nine men's shoe, it was determined that the maximum size available for an air bag 150 located in the back portion of the midsole is 20.0 cubic cm. In addition, the U.S. size nine men's shoe has an interior volume of 85.9 cubic cm. Thus, the relationship of the shoe volume to the air bag size is approximately 85.9/20.0=4.3, which means that the air bag is approximately 23.3 percent of the total volume of the shoe interior. This relationship should be maintained to determine the air bag size for a particular shoe size to provide the desired cooling effect.

Various changes and modifications and equivalents of the embodiment described above and shown in the drawings may be made within the scope of this invention. It is intended that all matters contained in the above description or shown in the accompanying drawings are presented by way of example only and are intended to be interpreted in an illustrative and not limiting sense.

What is claimed is:

1. A ventilation system for an athletic shoe, comprising:

(1) an upper having perforations through which ambient air can enter from outside of the athletic shoe into the athletic shoe; and (2) an athletic shoe sole assembly secured to the periphery of said upper, said upper and said sole assembly defining an athletic shoe interior, comprising:

(a) a footbed having a plurality of perforations extending therethrough, and having a footbed forefoot portion with an opening therethrough that is larger than the plurality of perforations;

(b) an insole positioned below and parallel to said footbed with an insole forefoot portion, and having a second opening passing therethrough aligned with the opening in said footbed;

(c) a midsole comprising a top surface, a bottom surface, a midsole forefoot portion, an instep portion, and a heel portion, integral means forming an upper portion of an air chamber in said heel portion, midsole means forming a duct in the instep portion and midsole forefoot portion connecting a third opening in said midsole forefoot portion and said air chamber, said third and second openings aligned with one another, a first one-way valve in said duct for permitting air to enter said air chamber but not to exit said air chamber, a second one-way valve at the rear of said heel portion connected to said air chamber for permitting air to exit said air chamber but not to enter said air chamber;

(d) an outersole adjacent said midsole forming a bottom portion of said air chamber; and, (e) said footbed, insole, midsole, and outersole secured together to form a unitary sole assembly with an air passage extending from said athletic shoe interior through said openings, duct and air chamber, whereby said perforations in said upper allow ambient air to pass into said athletic shoe through said perforations, about the wearer's foot and then through said air passage, with said valves causing said air to flow in one direction in said duct to said air chamber, and on occurrence of a downward pressure due to the weight of the wearer's foot, to be expelled from said air chamber rearwardly through said second one-way valve, wherein said air chamber has an interior volume, the volume of said athletic shoe interior is approximately 4.3 times larger than said air chamber interior volume.

2. The ventilation system according to claim 1, wherein said midsole further comprises longitudinally resilient pillars within said air chamber in said heel portion, said pillars being spaced apart from one another so as to return said air chamber to an original expanded condition when said air chamber is not subject to a compressive force.

3. The ventilation system according to claim 2, wherein said outer sole has a heel portion; and upwardly projecting supports in said heel portion of said outersole are each aligned with respective pillars in said air chamber to support the bottom surfaces of said pillars.

* * * * *